US007947167B2

(12) United States Patent
Osaheni et al.

(10) Patent No.: US 7,947,167 B2
(45) Date of Patent: May 24, 2011

(54) METHODS AND SYSTEMS FOR REMOVING METALS FROM LOW GRADE FUEL

(75) Inventors: John Aibangbee Osaheni, Clifton Park, NY (US); John Matthew Bablin, Malta, NY (US); Deborah Ann Haitko, Schenectady, NY (US); Grigorii Lev Soloveichik, Latham, NY (US)

(73) Assignee: General Electric Company, Schenectady, NY (US)

( * ) Notice: Subject to any disclaimer, the term of this patent is extended or adjusted under 35 U.S.C. 154(b) by 729 days.

(21) Appl. No.: 11/761,674

(22) Filed: Jun. 12, 2007

(65) Prior Publication Data

US 2008/0308465 A1 Dec. 18, 2008

(51) Int. Cl.

| | |
|---|---|
| ***C10G 29/04*** | (2006.01) |
| ***C10G 25/00*** | (2006.01) |
| ***C10G 25/03*** | (2006.01) |
| ***C10G 25/05*** | (2006.01) |

(52) U.S. Cl. ..... 208/251 R; 208/253; 208/299; 208/307

(58) Field of Classification Search ..... 196/46.1; 208/177, 251 R, 253, 283, 284, 287, 288, 208/299, 307

See application file for complete search history.

(56) References Cited

U.S. PATENT DOCUMENTS

| | | | | |
|---|---|---|---|---|
| 2,884,369 | A * | 4/1959 | Mattox et al. | 208/251 R |
| 3,839,187 | A * | 10/1974 | Vanvenrooy | 208/214 |
| 4,116,820 | A | 9/1978 | Blytas | |
| 4,528,100 | A | 7/1985 | Zarchy | |
| 5,358,634 | A | 10/1994 | Rankel | |
| 6,007,705 | A | 12/1999 | Greaney et al. | |
| 6,013,176 | A | 1/2000 | Greaney et al. | |
| 6,245,223 | B1 * | 6/2001 | Gorbaty et al. | 208/251 R |
| 6,372,124 | B2 | 4/2002 | Reid et al. | |
| 2003/0168381 | A1 | 9/2003 | Hokari et al. | |
| 2005/0040081 | A1 | 2/2005 | Takahashi et al. | |
| 2006/0011511 | A1 | 1/2006 | Hokari et al. | |

FOREIGN PATENT DOCUMENTS

WO 99/31199 A 6/1999

OTHER PUBLICATIONS

EP Search Report Dated Nov. 26, 2008.

* cited by examiner

*Primary Examiner* — Glenn Caldarola
*Assistant Examiner* — Randy Boyer
(74) *Attorney, Agent, or Firm* — GE Global Patent Operation; Catherine J. Winter

(57) ABSTRACT

A method for removing metals from fuel containing vanadium or nickel including intimately mixing an adsorbent with the fuel and isolating the treated fuel. The treated fuel has reduced levels of vanadium, nickel and other metals. Systems for fuel treatment are also provided.

8 Claims, 1 Drawing Sheet

METHODS AND SYSTEMS FOR REMOVING METALS FROM LOW GRADE FUEL

FIELD OF THE INVENTION

This invention relates to methods and systems for purifying low grade fuel and more particularly, to the removal of corrosive metals, such as vanadium and nickel.

BACKGROUND OF THE INVENTION

Low grade fuel is a cheap fuel and it would be desirable to use it to fuel gas turbines. However, low grade fuel contains undesirable contaminants, such as organic vanadium and nickel compounds, which have detrimental corrosion effects on gas turbines. Accordingly, it is necessary to remove the contaminants from the low grade fuel before it can be used in gas turbines.

Vanadium present in fuel is in a soluble porphyrin form and is difficult to remove by conventional separation techniques. Fractional distillation, for example, is capital intensive and requires highly skilled labor to operate. It is not suitable for frequent start-up and shut-down operations, and the footprint for distillation columns can also be very large. Adsorption of vanadium and nickel porphyrins on a solid sorbent can be used. However, conventional adsorption columns may not be readily applied to the removal of vanadium from very viscous fuels, as the pressure drop in such columns is very high.

U.S. Publication No. 2006/0011511 A1 published on Jan. 19, 2006, discloses a heavy oil reforming method for preparing fuel suitable for a gas turbine. The heavy oil is reacted with supercritical water and then with a scavenger to eliminate sulfur and vanadium from the heavy oil.

What is needed is an improved method for removing metals from low grade fuel.

SUMMARY OF THE INVENTION

In one embodiment, a method for removing metals from fuel containing vanadium or nickel, said method comprising intimately mixing an adsorbent with the fuel and isolating the treated fuel.

In another embodiment, a system for treating fuel containing vanadium or nickel, said system comprising a mixer for intimately mixing the fuel with an adsorbent and a separator for removing the adsorbent from the treated fuel.

In another embodiment, a system for treating fuel containing vanadium or nickel, said system comprising a mixer for intimately mixing the fuel with an adsorbent and a filter unit for removing the adsorbent from the treated fuel.

The various embodiments provide efficient methods and systems for removing vanadium, nickel and other metals from low-grade fuel. The systems and methods are amenable to frequent start-ups and shut-downs and are simple to operate.

DETAILED DESCRIPTION OF THE INVENTION

Figure 1:
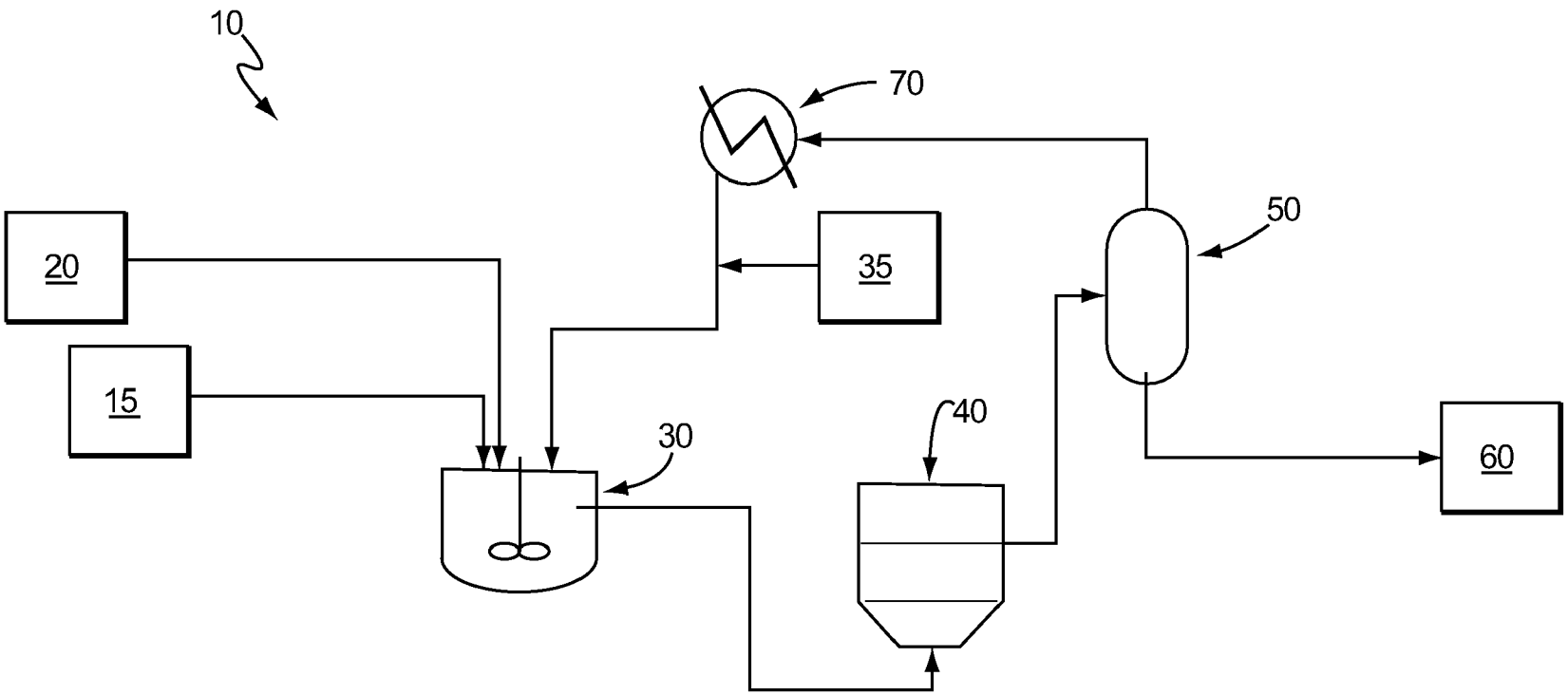
FIG. 1 is a schematic diagram depicting an exemplary embodiment of a system for removing vanadium, nickel and other metals from contaminated fuel.

The singular forms "a," "an" and "the" include plural referents unless the context clearly dictates otherwise. The endpoints of all ranges reciting the same characteristic are independently combinable and inclusive of the recited endpoint. All references are incorporated herein by reference.

The modifier "about" used in connection with a quantity is inclusive of the stated value and has the meaning dictated by the context (e.g., includes the tolerance ranges associated with measurement of the particular quantity).

"Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present.

In one embodiment, a method for removing metals from fuel containing vanadium or nickel, said method comprising intimately mixing an adsorbent with the fuel and isolating the treated fuel.

In one embodiment, a method for removing metals from fuel containing vanadium or nickel, said method comprising intimately mixing an adsorbent with the fuel and isolating the treated fuel.

Fuel containing vanadium or nickel is fuel, such as a low-grade fuel, having corrosive vanadium or nickel. In one embodiment, the fuel contains both vanadium and nickel. The fuel may be fossil fuels, such as crude oils and bituminous, processed/distilled residues, such as coker oils, coker gas oils, atmospheric and vacuum residual oil, fluid catalytic cracker feeds, metal containing deasphalted oils and resins, processed residual oil and heavy oils. The fuel may also contain other metals, such as sodium and iron.

The fuel containing vanadium or nickel can have a range of metal content and any level of nickel and/or vanadium can be treated. In one embodiment, the fuel has up to about 500 ppm by weight vanadium. In another embodiment, the fuel has about 0.5 ppm by weight or more of vanadium. In another embodiment, the fuel has from about 0.5 ppm by weight to about 500 ppm by weight vanadium. In one embodiment, the fuel has up to about 200 ppm by weight nickel. In another embodiment, the fuel has about 0.8 ppm by weight or more of nickel. In another embodiment, the fuel has from about 0.8 ppm by weight to about 200 ppm by weight nickel. In one embodiment, the fuel includes both nickel and vanadium. In one embodiment, the fuel has up to about 500 ppm by weight vanadium and up to about 500 ppm by weight nickel. In another embodiment, the fuel has about 0.5 ppm by weight or more of vanadium and about 0.8 ppm by weight or more of nickel. In another embodiment, the fuel has from about 0.5 ppm by weight to about 500 ppm by weight vanadium and from about 0.8 ppm by weight to about 200 ppm by weight nickel. In another embodiment, the fuel has up to about 500 ppm by weight of other metals.

The adsorbent is any type of adsorbent that is capable of removing vanadium, nickel and other metals from fuel. In one embodiment, the adsorbent has a high surface area. In another embodiment, the adsorbent has a surface area of at least about 200 $m^2/g$. In another embodiment, the adsorbent has a surface area from about 200 $m^2/g$ to about 2400 $m^2/g$. In another embodiment, the adsorbent has a surface area from about 500 $m^2/g$ to about 1300 $m^2/g$.

In one embodiment, the adsorbents include, but are not limited to, activated aluminas, aluminum trihydrate, molybdenum oxide, petroleum coke, activated carbon, zeolites, clays, silicates, rice hull ash, inorganic oxides or combinations thereof. The clays may be fuller's earth, attapulgus clay, montmorillonite, halloysite, kaolin and the like. The silicates may be diatomaceous earth, kieselguhr, feldspar and the like. Inorganic oxides may be precipitated silica, fumed silica, zirconia, thoria, boria, silica-alumina, silica-zirconia, alumina-zirconia and the like. Activated carbons may be produced by the destructive distillation of wood, peat, lignite, nutshells, bones, coconut shells and other carbonaceous matter. Petroleum coke is a carbonaceous solid derived from oil refinery coker units or other cracking processes.

The adsorbent is used in any amount sufficient to remove vanadium, nickel and other metals from the contaminated fuel. In one embodiment, the amount of adsorbent is from about 1 to about 100 percent by weight based on the weight of the fuel. In another embodiment, the amount of adsorbent is from about 5 to about 60 percent by weight based on the weight of the fuel. In another embodiment, the amount of adsorbent is from about 10 to about 50 percent by weight based on the weight of the fuel.

The adsorbent and fuel containing vanadium or nickel are intimately mixed. In one embodiment, the fuel containing vanadium or nickel and adsorbent are mixed in a mixer, which may be any type of conventional mixer. In one embodiment, the mixer is a high speed or high intensity mixer. In one embodiment, the mixer is mixed from about 2 to about 1000 revolutions/s. In another embodiment, the mixer is mixed from about 50 to about 500 revolutions/s. In another embodiment, the mixer is mixed from about 100 to about 450 revolutions/s. The mixture is blended for a period of time to intimately disperse and contact each particle of the adsorbent with the contaminated fuel. In one embodiment, the mixture is blended from about 1 second to about 1 hour. In another embodiment, the mixture is blended from about 30 seconds to about 30 minutes. In another embodiment, the mixture is blended from about 1 minute to about 20 minutes.

The treated fuel is isolated from the adsorbent in any conventional manner. In one embodiment, the adsorbent is separated from the fuel in a separator, such as a settler or a centrifuge. In another embodiment, the adsorbent is filtered out of the fuel. The removed adsorbent may be regenerated. In one embodiment, the adsorbent is regenerated as in a process disclosed in U.S. Published Patent Application No. 2008/0308464, which is incorporated herein by reference.

The treated fuel has a reduced metal content. The actual amount of residual metals will vary depending on the starting amount. In one embodiment, the amount of vanadium is about 1 ppm by weight or less. In another embodiment, the amount of vanadium is about 0.5 ppm by weight or less. In another embodiment, the amount of vanadium is about 0.2 ppm by weight or less. In one embodiment, the amount of nickel is about 1 ppm by weight or less. In another embodiment, the amount of nickel is about 0.8 ppm or less. In another embodiment, the amount of nickel is about 0.2 ppm or less. In one embodiment, the vanadium and nickel contents are less than 0.2 ppm. In another embodiment, the vanadium and/or nickel contents are undetectable by ICP/MS testing.

In one embodiment, a solvent may be mixed with the fuel containing vanadium or nickel and the adsorbent. The solvent reduces the viscosity of the fuel and promotes adsorption of the metals onto the adsorbent. After the fuel has been treated, the solvent may be volatilized, such as in a flash unit or a distillation column and removed from the treated fuel. The solvent may be discarded or collected and recycled. In one embodiment, the solvent is removed from a flash unit or distillation column in gaseous form, condensed in a condenser and reused for treating the fuel containing vanadium or nickel.

The solvent may be any type of solvent in which the fuel containing vanadium or nickel is at least partially soluble and does not react with the fuel. In one embodiment, the fuel is soluble in the solvent. In one embodiment, the solvent is a hydrocarbon, a cyclic hydrocarbon or an aromatic hydrocarbon. In another embodiment, the solvent may be a ketone, alcohol, ether, polyether, cyclic ether or ester. In another embodiment, the solvent may be benzene, toluene, hexane, cyclohexane, petroleum ether, tetralin, octane, cyclooctane, heptane, cycloheptane, pentane, diethyl ether, methylethyl ether or acetone. In one embodiment, the solvent is one of the light components of the fuel, including but not limited to, benzene, toluene, hexane, cyclohexane, petroleum ether, tetralin, octane, cyclooctane, heptane, cycloheptane or pentane. In another embodiment, the solvent is petroleum ether.

The solvent may be added in any amount suitable for reducing the viscosity of the fuel and depends on the characteristics of the fuel. In one embodiment, the solvent is added in an amount of from about 20 percent by weight to about 1000 percent by weight, based on the weight of the fuel. In another embodiment, the solvent is added in an amount of from about 50 percent by weight to about 500 percent by weight, based on the weight of the fuel. In another embodiment, the solvent is added in an amount of from about 100 percent by weight to about 300 percent by weight, based on the weight of the fuel.

The solvent may be mixed with the fuel containing vanadium or nickel and the adsorbent in any conventional manner. Order of addition is not critical. In one embodiment, the fuel containing vanadium or nickel, the adsorbent and solvent are intimately mixed in a mixer. The mixer may be any type of conventional mixer. In one embodiment, the mixer is a high speed mixer or a high intensity mixer. In one embodiment, the mixer is mixed from about 2 to about 1000 revolutions/s. In another embodiment, the mixer is mixed from about 50 to about 500 revolutions/s. In another embodiment, the mixer is mixed from about 100 to about 450 revolutions/s. The mixture is blended for a period of time to intimately disperse and contact each particle of the adsorbent with the contaminated fuel. In one embodiment, the mixture is blended from about 1 second to about 1 hour. In another embodiment, the mixture is blended from about 30 seconds to about 30 minutes. In another embodiment, the mixture is blended from about 1 minute to about 20 minutes.

In another embodiment, a system for treating fuel containing vanadium or nickel, said system comprising a mixer for intimately mixing the fuel with an adsorbent and a separator for removing the adsorbent from the treated fuel.

In another embodiment, a system for treating fuel containing vanadium or nickel, said system comprising a mixer for intimately mixing the fuel with an adsorbent and a filter unit for removing the adsorbent from the treated fuel. The filter unit filters out the adsorbent from the fuel and may be any conventional filter that separates solids from liquids.

In one embodiment, a system for treating contaminated fuel can be made in the form of a simple skid for easily integrating the system with refinery operations and supplying treated fuel to gas turbines.

FIG. 1 is a schematic diagram depicting an exemplary embodiment of a system 10 for removing vanadium, nickel and other metals from a fuel 15 containing vanadium or nickel. The fuel 15 and an adsorbent 20 are fed to a mixer 30. In one embodiment, the mixer 30 is a high speed or high-intensity mixer. The fuel is intimately mixed with the adsorbent 20 and optionally, with a solvent 35. The fuel is separated in a separator 40 or in a filter unit (not shown). In one embodiment, the separator 40 is a centrifuge or settler. If a solvent 35 is present, it is volatilized and removed from the treated fuel 60. In one embodiment, the solvent 35 is volatilized in a flash unit 50 or in a distillation column (not shown). Treated fuel 60 is removed from the flash unit 50 or distillation column (not shown). If a solvent 35 is not used, the treated fuel 60 is removed directly from the separator 40 or filter unit (not shown). The treated fuel 60 is a liquid having a reduced amount of vanadium, nickel and other metals. In one embodiment, the treated fuel 60 has less than about 0.5 ppm vanadium and less than about 0.8 ppm nickel and may be used to fuel a Gas Turbine. When a solvent is being used, the volatilized solvent may be discarded (not shown) or may be recycled to the mixer 30. The solvent 35 is volatilized into a gaseous phase in a flash unit 50 or a distillation column (not shown), condensed in a condenser 70 and recycled to the mixer 30.

The methods and systems may be operated in a batch mode, continuous mode or semi-continuous mode.

In order that those skilled in the art will be better able to practice the present disclosure, the following examples are given by way of illustration and not by way of limitation.

EXAMPLES

Example 1

100 g of a heavy oil, Valero® Coker gas oil, having a vanadium content of 15 ppm, 20 g of activated carbon (Calgon® RB, BET surface area=1,300 $m^2/g$) and 100 g of tetralin were added to a Waring® blender. The mixture was mixed for 2 minutes at 400 revs/s. The mixture was poured into a centrifuge tube and centrifuged at 2100 rpm for 10 minutes. The fuel fraction was decanted and tested. The vanadium content was measured using ICP/MS. The residual vanadium was 0.1 ppm.

Example 2

100 g of a heavy oil, Valero® Coker gas oil, having a content of 15 ppm vanadium and 3.2 ppm nickel and 200 g of petroleum ether (Calgon® RB) were added to a Waring® blender. 15 g of Activated Carbon (Calgon® RB, BET surface area=1,300 $m^2/g$) was then added to the blender. The mixture was mixed for 2 minutes at 450 revs/s. The mixture was poured into a centrifuge tube and centrifuged at 2100 rpm for 10 minutes to separate the Activated Carbon from the fuel. The residual petroleum ether was evaporated at 60° C. under a slight vacuum of about 15 mmHg. The vanadium content of the resulting oil was tested by ICP/MS and was found to be 0.18 ppm. Residual nickel was not detected.

Example 3

100 g of a heavy oil, Valero® Coker gas oil, having a vanadium content of 15 ppm and 3.2 ppm nickel and 200 g of hexane were added to a Waring® blender. 15 g of Activated Carbon (Norit®, BET surface area=604 $m^2/g$) was then added to the blender. The mixture was mixed for 2 minutes at 400 revs/s. The mixture was added to a centrifuge tube and centrifuged at 2100 rpm for 10 minutes to separate the carbon from the fuel. The residual hexane was evaporated at 60° C. under slight vacuum of about 15 mmHg. The vanadium and nickel contents of the resulting oil were tested by ICP/MS and found to be 0.94 ppm vanadium and the nickel content was about 0.39 ppm.

While typical embodiments have been set forth for the purpose of illustration, the foregoing descriptions should not be deemed to be a limitation on the scope herein. Accordingly, various modifications, adaptations and alternatives may occur to one skilled in the art without departing from the spirit and scope herein.

Having described the invention, that which is claimed is:

1. A method for the removal of metals from fuel containing vanadium or nickel, said method comprising intimately mixing an adsorbent and a solvent with the fuel in a mixer to treat the fuel and isolating the treated fuel, wherein the solvent is a light component of the fuel containing vanadium or nickel.

2. The method of claim 1, wherein the adsorbent is selected from the group consisting of activated alumina, aluminum trihydrate, molybdenum oxide, petroleum coke, activated carbon, zeolite, clay, silicate, rice hull ash, inorganic oxides and combinations thereof.

3. The method of claim 1, wherein the solvent is added in an amount of from about 20 percent by weight to about 1000 percent by weight, based on the weight of the fuel.

4. The method of claim 1, wherein the fuel containing vanadium or nickel, adsorbent and solvent are mixed from about 50 to about 500 revolutions/s.

5. The method of claim 4 wherein the contaminated fuel, adsorbent and solvent are mixed from about 1 second to about 1 hour.

6. The method of claim 1, further comprising separating the solvent from the treated fuel.

7. The method of claim 6 wherein the solvent is separated from the treated fuel by volatilizing the solvent in a flash unit or in a distillation column.

8. The method of claim 7 further comprising condensing the volatilized solvent and reusing the condensed solvent for mixing with the fuel containing vanadium or nickel, and adsorbent.

* * * * *